United States Patent [19]

Kudlacek

[11] Patent Number: 4,838,236

[45] Date of Patent: Jun. 13, 1989

[54] COMPOUND ARCHERY BOW WITH ADJUSTABLE DRAW LENGTH AND PULL WEIGHT

[76] Inventor: Donald S. Kudlacek, 3412 Oak St., Longview, Wash. 98632

[21] Appl. No.: 214,497

[22] Filed: Jul. 1, 1988

[51] Int. Cl.[4] ..... F41B 5/00

[52] U.S. Cl. ..... 124/23 R; 124/DIG. 1

[58] Field of Search ..... 124/23 R, 24 R, DIG. 1, 124/90

[56] References Cited

U.S. PATENT DOCUMENTS

| | | | |
|---|---|---|---|
| 4,078,538 | 3/1978 | Shepley | 124/24 R |
| 4,201,177 | 5/1980 | Holman et al. | 124/23 R |
| 4,241,715 | 12/1980 | Jennings | 124/24 R |
| 4,353,346 | 10/1982 | Barna | 124/24 R |
| 4,368,718 | 1/1983 | Simonds et al. | 124/23 R |
| 4,401,097 | 8/1983 | Simonds et al. | 124/23 R |
| 4,438,753 | 3/1984 | Simonds | 124/24 R |
| 4,455,990 | 6/1984 | Barna | 124/24 R X |
| 4,515,142 | 5/1985 | Nurney | 124/23 R |
| 4,519,374 | 5/1985 | Miller | 124/23 R |

*Primary Examiner*—Andrew V. Kundrat
*Assistant Examiner*—John Ricci
*Attorney, Agent, or Firm*—Olson and Olson

[57] ABSTRACT

The draw length and pull weight of a compound archery bow may be varied over a desired range by changing the positions of anchoring the ends of the bow string and power cable on the cam elements at the outer ends of the bow limbs. Each cam element is provided with a plurality of openings arranged in a desired pattern, and an anchor member is secured removably at any one of the openings by a screw extended through the opening and threaded into a tapped opening in the anchor member. A groove in the outer circumference of each anchor member removably recieves a looped end of the bow string or power cable.

10 Claims, 1 Drawing Sheet

COMPOUND ARCHERY BOW WITH ADJUSTABLE DRAW LENGTH AND PULL WEIGHT

BACKGROUND OF THE INVENTION

This invention relates to compound archery bows, and more particularly to a compound archery bow in which the draw lengths and pull weights are adjustable over an operative range.

Compound archery bows have been provided heretofore in a wide variety of structural configurations. Included are those described in my earlier U.S. Pat. Nos. 4,060,066 and 4,593,674. In all prior art compound archery bows, however, the draw lengths and pull weights are adjustable either by varying the diameters of the cams and their eccentric pivot points relative to their centers, or by adjusting the lead-out of the bow string. If the bow string is lengthened, the draw length and pull weight are both increased. However, this is effective only to the limit of full wrap on the cams. If the bow string is shortened, the draw length and pull weight are both decreased. However, this is effective only to the limit of the decreased rotation of the cams. These requirements necessitate the costly inventory of a large number of cams and incur considerable time and inconvenience in making such substitutions.

SUMMARY OF THE INVENTION

This invention provides a compound archery bow with a pair of cam elements each of which is provided with a plurality of anchored positions for a bow string and a power cable, for selective use to achieve any desired draw length and pull weight within a practicable range.

It is the principal objective of this invention to provide for compound archery bows a cam element which affords adjustment of draw length and pull weight over a selected range.

Another objective of this invention is the provision for compound archery bows a cam element of the class described which may be of single groove or dual groove type.

Still another objective of this invention is to provide for compound archery bows a cam element of the class described which is usable with a wide variety of bows.

A further objective of this invention is the provision for compound archery bows a cam element of the class described which includes simplified anchor means for facilitating the adjustment of the anchor points.

A still further objective of this invention is the provision for compound archery bows a cam element of the class described which is of simplified construction for economical manufacture.

Another objective of this invention is to provide for compound archery bows a method of utilizing the cam elements to effect varying the draw length and pull weight over desired ranges.

The foregoing and other objects and advantages of this invention will appear from the following detailed description, taken in connection with the accompanying drawings of preferred embodiments.

DESCRIPTION OF THE PREFERRED EMBODIMENTS

Figure 1:
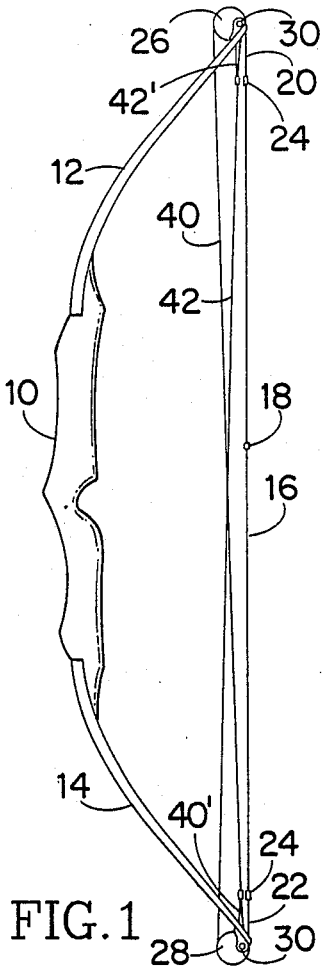
FIG. 1 is a side elevation of a compound archery bow having incorporated therewith a single groove cam element embodying the features of this invention, the bow being shown in rest position.
Figure 2:
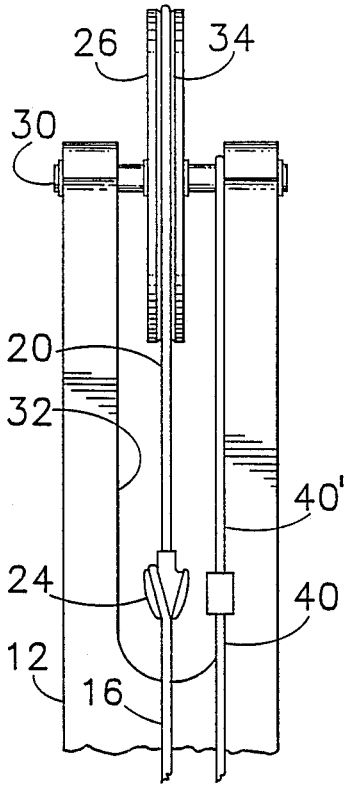
FIG. 2 is a fragmentary enlarged scale rear elevation of the upper limb and cam element as viewed from the right in FIG. 1.

The compound archery bow shown in FIG. 1 is described in detail in my earlier U.S. Pat. No. 4,593,674. Briefly, it includes a central handle member 10 and a pair of resilient bow limbs 12 and 14 extending outwardly from opposite ends of the handle member.

The bow also includes a bowstring by which an arrow is projected. As illustrated, the bowstring includes an elongated intermediate working stretch 16 provided with the usual nocking point 18, and a pair of opposite end segments 20 and 22 connected detachably to the opposite ends of the working stretch by coupling members 24. The bowstring end segments are trained about a pair of cam elements 26 and 28 respectively, mounted at the outer ends of the limbs 12 and 14, respectively, each by means of an eccentrically located pivot shaft 30. Each cam element is received freely within a central slot 32 provided in the outer end of each limb.

The cam element 26 illustrated in FIGS. 1–4 is in the form of a circular disc provided with a single circumferential guide groove 34. The guide groove is interrupted to provide a pair of closely adjacent terminal ends 36 and 38. One terminal end defines the terminal end of the guide groove for the bowstring end segment 20. The other terminal end 38 defines the terminal end of the guide groove for a power cable 40. It will be apparent that the single peripheral groove 34 serves to guide both the bowstring end segment and the power cable during rotation of the cam element.

The terminal end of each end segment of the bowstring and one end of each power cable is anchored to its associated cam element in a manner described in detail hereinafter.

The power cable, which can be conventional plastic clated steel cable or various other string materials that do not stretch, extends from its anchor on the cam element 26 outwardly to terminal end 38 and then is trained back onto the guide groove 34. It then extends to the pivot shaft 30 of the opposite cam element 28 on the opposite limb 14, where it is secured by a closed loop 40' formed at the end of the cable.

It will be understood that a second power cable 42 is anchored at one end to cam element 28 on limb 14 and extends to the pivot shaft 30 of the opposite cam element 26 on limb 12.

Figure 3:
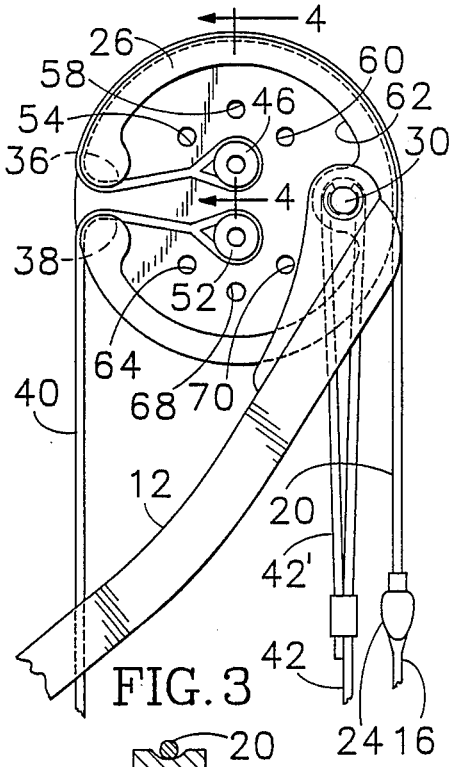
FIG. 3 is a fragmentary enlarged scale side elevation of the upper limb and cam element of FIG. 1.
Figure 4:
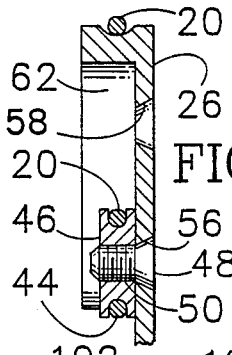
FIG. 4 is a fragmentary sectional view taken on the line 4—4 in FIG. 3.

Referring now to FIGS. 3 and 4 of the drawings, the terminal end of end segment 20 of the bowstring 16 is formed as a loop for seating in a peripheral groove 44 in the outer periphery of an anchor member 46. The periphery is illustrated as being circular in form. The anchor member is secured removably to the cam element by means of a screw 48 extended through an opening in the cam element and threaded into a tapped bore 50 in the anchor member.

In similar manner, the corresponding terminal end of the power cable 40 is formed as a loop for seating in a peripheral groove in the outer periphery of a second anchor member 52. Like the first mentioned anchor member 46, the second one also is secured removably to the cam element by a screw extended through an opening in the cam element and threaded into a tapped bore in the second anchor member.

In accordance with this invention, each cam element is provided with means for attaching each anchor member selectively at any one of a plurality of distances from the terminal ends of the bowstring guide groove and the power cable guide groove. In the embodiment illustrated, the cam element 26 is provided with a plurality of openings, for example openings 54, 56, 58 and 60 spaced apart in a selected pattern within a recess 62 in one side of the cam element, for selectively positioning the anchor member 46 for the associated bowstring end segment 20. Each of the openings is spaced a different distance from the associated terminal end 36 of the bowstring guide groove.

The same pattern of openings is provided in the opposite cam element 28, so that each opening forms a pair with the same opening in cam element 26.

Accordingly, each pair of openings in the opposite cam elements 26 and 28 are spaced apart at different distances from the other pairs of openings. Since the length of the bowstring between the end loops on the end segments remains constant, the attachment of the end loops to anchor members 46 positioned selectively in different pairs of the openings, results in corresponding changes in draw length of bowstring.

Similarly, a second pattern of spaced apart openings, for example openings 64, 66, 68 and 70, also is provided in the recess 62 of the cam element 26 for selectively locating the anchor member 52 for the associated power cable 40. The openings are spaced at different distances from the terminal end 38 of the power cable guide groove, whereby to provide different distances to the pivot shaft 30 which anchors the opposite end of the cable. Accordingly, the attachment of the ends of the power cables 40 and 42 to the associated cam elements 26 and 28 selectively at each pair of openings, results in corresponding changes in the pull weight.

To illustrate the function of the openings as attachment positions, it has been determined empirically with a particular compound archery bow that the position of the bowstring end segment anchor member 46 at each of the openings, 54, 56, 68 and 60 respectively, provides draw lengths of 26, 27, 28 and 29 inches, respectively.

With the anchor member 46 located at opening 26, the positions of the power cable anchor member at openings 64, 66, 68 and 70, respectively, provides pull weights of 55, 58, 62 and 65 lbs., respectively.

With the position of bowstring end segment anchor member 46 at opening 60, the position of the power cable anchor member at openings 64, 66, 68 and 70, respectively, provides pull weights of 70, 73, 77 and 80 lbs., respectively.

The pull weights at the foregoing anchor positions with the bowstring end segment anchor members at the intermediate positions of openings 56 and 58, are intermediate the above identified minimum and maximum pull weights.

Figure 5:
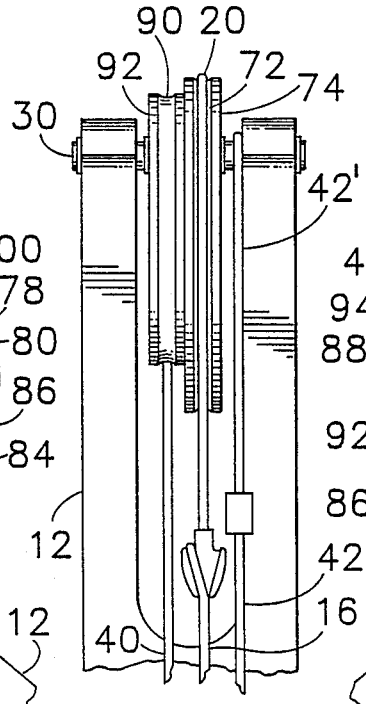
FIG. 5 is a fragmentary rear elevation similar to FIG. 2, showing a dual groove cam component embodying the features of this invention.
Figure 6:
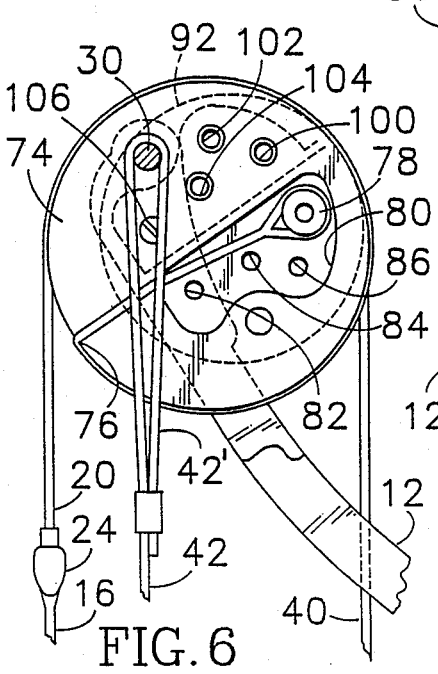
FIG. 6 is a fragmentary enlarged scale side elevation of the upper limb and cam component of FIG. 5, as viewed from the right in FIG. 5.
Figure 7:
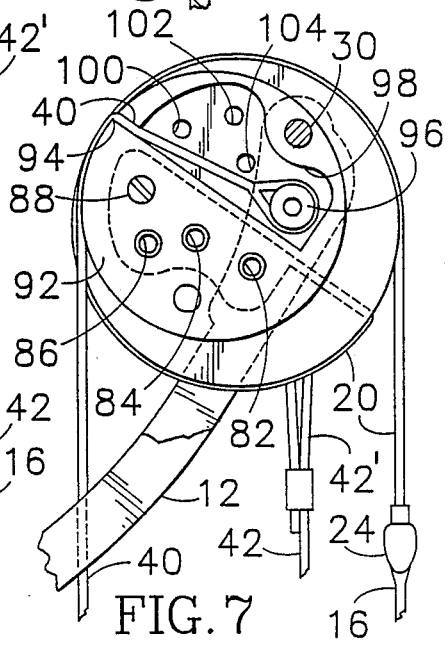
FIG. 7 is a fragmentary side elevation similar to FIG. 6 but showing the opposite side of the cam component as viewed from the left in FIG. 5.

As previously mentioned, a range of draw lengths and pull weights also may be afforded for dual groove cam members. Such a cam member is incorporated in the compound archery bow illustrated in FIGS. 5–7 and described in detail in my earlier U.S. Pat. No. 4,060,066.

Each bowstring end segment is anchored to one of the cam elements of the cam component. As illustrated, the bowstring end segment 20 is trained about a groove 72 in the larger diameter cam element 74. The bowstring end segment extends inwardly from the terminal end 76 of the guide groove and, as described hereinbefore, its terminal end is formed as a loop for seating in an annular groove in the outer circumference of an anchor member 78.

This larger diameter cam element 74 is provided with a recess 80 in its outer face in which is disposed a plurality of openings, for openings 82, 84, 86 and 88, spaced apart in a selected pattern with each of the openings spaced a different distance from the terminal end 76 of the guide groove. As in the previously described embodiment, the anchor member 78 may be positioned at any one of these openings to provide a desired draw length, and is secured removably to the cam element by a screw extended through a selected one of the openings in the cam element and threaded into a tapped bore in the anchor member.

In similar manner, the power cable 40 is trained onto the groove in the smaller diameter cam element 92 and extended inwardly from the terminal end 94 of the guide groove. The inner end of the cable is formed as a loop for seating in the annular groove in the outer circumference of a second anchor member 96. This smaller diameter cam element is provided with a recess 98 in its outer face in which is disposed a plurality of openings, for example openings 100, 102, 104 and 106, spaced apart in a selected pattern and each a different distance from the terminal end 94 of the guide groove 90. The anchor member 96 thus may be positioned at any one of these openings to provide a desired pull weight. As previously described, the anchor member is secured removably to the cam element by a screw extended through a selected one of the openings in the cam element and threaded into a tapped bore in the anchor member.

Thus, draw lengths and pull weights are varied by changing the positions of the anchor members 78 and 96, respectively, in the associated groups of openings in the larger and smaller cam elements 74 and 92, respectively, in the same manner as described hereinbefore in connection with the single groove cam elements 26 and 28.

For both embodiments described hereinbefore, the magnitudes of draw lengths and pull weights depend at least in part on the diameters of the cam elements employed. Thus, the greater the diameter the greater the draw length and pull weight for corresponding anchor positions. As previously mentioned, for any anchor position of the bowstring end segments the draw length remains substantially constant throughout the range of pull weights provided by the pattern of openings for the associated anchor members. However, the pull weight varies slightly over the range of positions of the bowstring end segment anchor members for any one of the positions of the power cable anchor members.

It will be appreciated from the foregoing that this invention provides a compound archery bow with a substantial range of draw lengths and pull weights by the simple expediency of changing the anchor positions of the ends of the bowstring and power cables on the cam elements at the outer ends of the limbs.

It will be apparent to those skilled in the art that various changes may be made in the size, shape, type, number and arrangement of parts described hereinbefore. For example, the attachment openings in the cam elements may be replaced with elongated slots, adjustable carriages, and other means for supporting anchor members for adjustment to different distances from the terminal ends of the guide grooves. The bowstring may be in the form of a single length, rather than with detachable end segments described herein, and hence the end segments are to be considered to be as integral parts of the bowstring. The power cables may be connected operatively to the limbs opposite their cam connections, in a variety of ways, such as through the lever system described in my earlier U.S. Pat. No. 4,593,674. Although the cam elements are of circular configuration in the embodiments illustrated, they may be oblong or other non-circular configurations, as desired. Their pivotal attachments to the limbs may be provided in a variety of structural arrangements, such as the arrangement described in my earlier U.S. Pat. No. 4,060,066. The foregoing and other modifications and changes may be made, as desired, without departing from the spirit of this invention and the scope of the appended claims.

I claim:

1. In a compound archery bow having a central handle member, a pair of limbs extending outwardly from opposite ends of the handle member, a cam member on the outer end of each limb, a bowstring extending between and attached to said cam members, and a pair of power cables each attached at one end to a different cam member and at the opposite end operatively to the opposite limb, the method of varying the pull weight of the bow within a range of pull weights, comprising changing the position of attachment of each power cable to the associated cam member to any one of a plurality of attachment positions, to change the distance between said position of attachment and the point of attachment of the opposite end operatively to the opposite limb, by securing said one end of each power cable selectively to any one of a plurality of attachment positions on the associated cam member to change the distance between selective attachment positions of each power cable.

2. In a compound archery bow having a central handle member, a pair of limbs extending outwardly from opposite ends of the handle member, a cam member on the outer end of each limb, a bowstring extending between and attached to the cam members, and a pair of power cables each attached at one end to a different cam member and at the opposite end operatively to the opposite limb, the method of varying the draw length and pull weight of the bow within a range of draw lengths and pull weights, comprising changing the position of attachment of the bowstring to each cam member to any one of a plurality of attachment positions to change the distance between selected pairs of attachment positions, by securing the ends of the bowstring selectively to any one of a plurality of attachment positions on the cam members, and changing the position of attachment of each power cable to the associated cam member to any one of a plurality of attachment positions to change the distance between said position of attachment and the point of attachment of the opposite end operatively to the opposite limb, by securing said one end of each power cable selectively to any one of a plurality of attachment positions on the associated cam member to change the distance between selected attachment positions of each power cable.

3. For use in a compound archery bow having a handle member and a pair of limbs extending outwardly from opposite ends of the handle member, cam pivot means at the outer end of each limb for mounting a cam member thereon, a bowstring configured for attachment of its opposite ends to cam members on said pivot means, and a pair of power cables each attached at one end operatively to a different one of the limbs and configured for attachment of the opposite end of each power cable to a cam member on the opposite limb, a cam member comprising:

(a) a cam body,
(b) pivot engaging means on the cam body for mounting said body on a cam pivot, means,
(c) a peripheral bowstring guide groove on said body having a terminal end,
(d) a peripheral power cable guide groove on said body having a terminal end,
(e) bowstring attachment means on said body for attaching one end of a bowstring to said body, and
(f) power cable attachment means on said body for attaching one end of a power cable to said body,
(g) said power cable attachment means being arranged for positioning selectively at any one of a plurality of distances from the terminal end of the associated power cable guide groove.

4. For use in a compound archery bow having a handle member and a pair of limbs extending outwardly from opposite ends of the handle member, cam pivot means at the outer end of each limb for mounting a cam member thereon, a bowstring configured for attachment of its opposite ends to cam members on said pivot means, and a pair of power cables each attached at one end operatively to a different one of the limbs and configured for attachment of the opposite end of each power cable to a cam member on the opposite limb, a cam member comprising:

(a) a cam body,
(b) pivot engaging means on the cam body for mounting said body on a cam pivot means,
(c) a peripheral bowstring guide groove on said body having a terminal end,
(d) a peripheral power cable guide groove on said body having a terminal end,
(e) bowstring attachment means on said body for attaching one end of a bowstring to said body, and
(f) power cable attachment means on said body for attaching one end of a power cable to said body,
(g) the bowstring attachment means being arranged for positioning selectively at any one of a plurality of distances from the terminal end of the bowstring guide groove, and the power cable attachment means being arranged for positioning selectively at any one of a plurality of distances from the terminal end of the power cable guide groove.

5. For use in a compound archery bow having a handle member and a pair of limbs extending outwardly from opposite ends of the handle member, cam pivot means at the outer end of each limb for mounting a cam member thereon, a bowstring configured for attachment of its opposite ends to cam members on said pivot means, and a pair of power cables each attached at one end operatively to a different one of the limbs and configured for attachment of the opposite of each power cable to a cam member on the opposite limb, a cam member comprising:

(a) a cam body,
(b) pivot engaging means on the cam body for mounting said body on a cam pivot means,
(c) a peripheral bowstring guide groove on said body having a terminal end,
(d) a peripheral power cable guide groove on said body having a terminal end,
(e) bowstring attachment means on said body for attaching one end of a bowstring to said body.
(f) power cable attachment means on said body for attaching one end of a power cable to said body, the power cable attachment means comprising an anchor member configured to releasably secure one end of the power cable, and
(g) means on the cam body for securing the anchor member selectively at any one of a plurality of distances from the associated guide groove terminal end.

6. The cam member of claim 5 wherein the securing means on the cam body comprises a plurality of openings in the cam body spaced apart at different distances from the terminal end of the associated guide groove, and a screw extending through a selected one of said openings and releasably engaging the anchor means.

7. The cam member of claim 5 wherein the anchor means has a peripheral groove configured to releasably seat a closed loop end of the power cable.

8. For use in a compound archery bow having a handle member and a pair of limbs extending outwardly from opposite ends of the handle member, cam pivot means at the outer end of each limb for mounting a cam member thereon, a bowstring configured for attachment of its opposite ends to cam members on said pivot means, and a pair of power cables each attached at one end operatively to a different one of the limbs and configured for attachment of the opposite end of each power cable to a cam member on the opposite limb, a cam member comprising:

(a) a cam body,
(b) pivot engaging means on the cam body for mounting said body on a cam pivot means,
(c) a peripheral bowstring guide groove on said body having a terminal end,
(d) a peripheral power cable guide groove on said body having a terminal end,
(e) bowstring attachment means on said body for attaching one end of a bowstring to said body, and
(f) power cable attachment means on said body for attaching one end of power cable to said body,
(g) the bowstring and power cable attachment means each comprising an anchor member configured to releasably secure one end of the bowstring or power cable, and means on the cam body for securing the anchor members selectively at any one of a plurality of distances from the associated guide groove terminal ends.

9. The cam member of claim 8 wherein the securing means on the cam body comprises a plurality of openings in the cam body spaced apart at different distances from the terminal end of the associated guide groove, and a screw extending through a selected one of said openings and releasably engaging the anchor means.

10. The cam member of claim 8 wherein the anchor means has a peripheral groove configured to releasably seat a closed loop end of a bowstring or power cable.

* * * * *